US009030127B2

(12) United States Patent
Chen

(10) Patent No.: US 9,030,127 B2
(45) Date of Patent: May 12, 2015

(54) CONTROLLING OBJECT APPEARANCE WITH VARIABLE SPECTRAL DISTRIBUTION OF LIGHTING HAVING CONSTANT CHROMATICITY

(71) Applicant: Nancy H. Chen, North Andover, MA (US)

(72) Inventor: Nancy H. Chen, North Andover, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 0 days.

(21) Appl. No.: 14/032,730

(22) Filed: Sep. 20, 2013

(65) Prior Publication Data

US 2015/0084542 A1 Mar. 26, 2015

(51) Int. Cl.
*H05B 37/02* (2006.01)

(52) U.S. Cl.
CPC ..... *H05B 37/0209* (2013.01)

(58) Field of Classification Search
CPC ..... H05B 33/086; F21V 23/0457
USPC ..... 315/294, 297, 307
See application file for complete search history.

(56) References Cited

U.S. PATENT DOCUMENTS

| | | | | |
|---|---|---|---|---|
| 2009/0184616 | A1* | 7/2009 | Van De Ven et al. | 313/1 |
| 2013/0002167 | A1* | 1/2013 | Van de Ven | 315/297 |
| 2013/0300305 | A1* | 11/2013 | Wray | 315/210 |
| 2014/0167646 | A1* | 6/2014 | Zukauskas et al. | 315/297 |

* cited by examiner

*Primary Examiner* — Don Le
(74) *Attorney, Agent, or Firm* — Andrew Martin

(57) ABSTRACT

Techniques are disclosed for controlling object appearance while maintaining a lighting function without noticeable changes in illumination. The techniques may be implemented to illuminate a given target with a first light source so as to cause the target to have a first appearance, and to illuminate the target with a second light source so as to cause the target to have a second appearance different from the first appearance. The first and second light sources have a chromaticity within a common MacAdam ellipse. The MacAdam ellipse size may range, for example, from a 7-step ellipse (for relaxed constancy in chromaticity) to a 1-step ellipse (for high constancy in chromaticity). In some cases, one of the first or second light sources includes a spectral feature not included in the other light source, and an optical response property of the target reacts to changes in the spectral feature thereby causing appearance changes.

20 Claims, 10 Drawing Sheets

CONTROLLING OBJECT APPEARANCE WITH VARIABLE SPECTRAL DISTRIBUTION OF LIGHTING HAVING CONSTANT CHROMATICITY

FIELD OF THE DISCLOSURE

The present application relates to lighting systems, and more specifically to techniques for controlling the appearance of objects in an illuminated space while maintaining a general lighting function without noticeable changes in the illumination.

BACKGROUND

Illuminating a given area or object is commonly done with any number of lighting fixtures, whether they be recessed ceiling fixtures, floor lamps, desk lamps, track lighting, overhead fluorescent lamps, sconces, and various combinations thereof, to name few examples. Theater lighting further allows for a typically higher degree of flexibility with respect to lighting aspects such as light direction, light color, and size of illuminated area. Objects to be lit are typically placed in a location where the light is appropriate and/or the lighting fixture itself can be positioned to provide the desired lighting of the object. Museums commonly use dedicated lighting for showing of artwork.

DETAILED DESCRIPTION

Figure 1A:
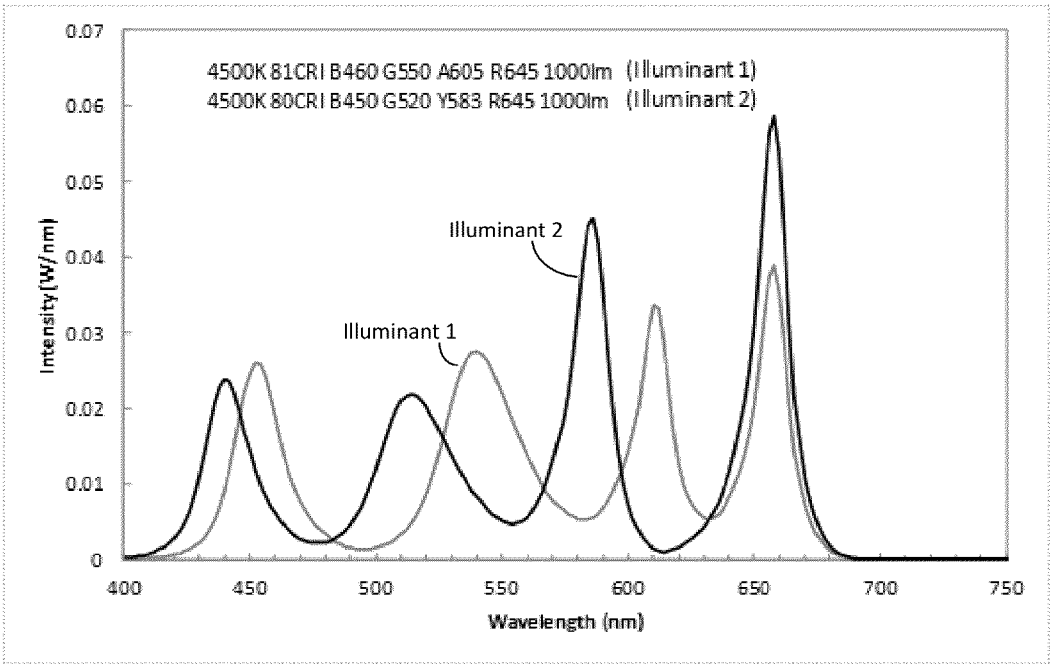
FIG. 1*a* and FIG. 1*b* each graphically shows two example white illuminants that can be used in accordance with an embodiment of the present invention.

Techniques are disclosed for controlling the appearance of objects in an illuminated space while maintaining a general lighting function without noticeable changes in the illumination. The techniques may be implemented as a lighting system configured to illuminate a given target with a first light source so as to cause the target to have a first appearance, and to illuminate the target with a second light source so as to cause the target to have a second appearance that is visibly different from the first appearance. In one example embodiment, the second light source has a chromaticity within a 3-step MacAdam ellipse of the chromaticity of the first light source. Other embodiments may use smaller (1-step or 2-step) or larger (4-step, 5-step, etc) MacAdam ellipses, depending on the desired level of constancy in chromaticity. For example, relaxed constancy may allow for use of a 7-step MacAdam ellipse, while a very tight constancy may call for use of a 1- or 2-step MacAdam ellipse. In some such example cases, one of the first or second light sources includes a spectral feature not included in the other light source, and an optical response property of the target reacts to changes in the spectral feature thereby causing changes in appearance. The first appearance may include, for instance, a first color, message and/or pattern and the second appearance may include a second color, message and/or pattern. As is known, in order for two chromaticities to be within 3-steps (or three standard deviations) of each other, one of them is at the center of the ellipse and the other is within the boundary of that 3-step ellipse. Any other chromaticities within that ellipse are also said to be within 3-steps of the center chromaticity. A similar explanation applies to other sized ellipses (1-step, 2-step, 4-step, etc).

General Overview

As previously noted, objects to be lit are typically placed in a location where the light is appropriate and/or the lighting fixture itself can be positioned to provide the desired lighting of the object. In some case, it may be desired to frequently change the visual appearance of an object in an illuminated space according to functional needs, decorative taste or whim, or some other reason, while maintaining functional illumination (generally white light) of the space. However, it may be further desired to also have no detectable changes in the general illumination of the space, as perceived by a human, while simultaneously changing the object's visual appearance. This would normally be accomplished by physically altering the object to appear as desired, or substituting other objects having the desired visual appearance for the given lighting situation. Such options, however, may not always be practical, or may otherwise be undesirable for whatever reason. In addition, once an object is altered or otherwise selected to provide a given appearance, that appearance is effectively static and any further changes in appearance will require further alterations.

Thus, and in accordance with an embodiment of the present invention, techniques are provided for controlling the appearance of objects in an illuminated space. No physical alterations to, or moving or swapping of, the object are required to switch, for example, from one appearance to another and back again. Rather, one or more spectral features of the illuminant spectrum (i.e., the light provided by the light source) are coordinated with optical properties of the object to be lit. In particular, changes in a given spectral feature of the light source are used to cause a change in appearance of the targeted object, because the optical response properties of the object react to the changes in the given spectral feature. Note, however, that the illuminant spectrum modifications are such that the chromaticity remains suitable for general lighting (e.g., white light), and possibly nearly constant so that the modifications to illumination are not perceptible or are otherwise minimally perceptible.

The object to be lit may be, for example, an item or set of items for display on a desk, shelf, or wall, or any other location. Alternatively, the object may be a surface such as an area on a wall, or a desk top, or a floor, or other planar or non-planar surface area. The object may naturally possess optical response properties that can be exploited as described herein, or alternatively can be prepped or otherwise engineered to have such optical response properties. An optical response property as used herein refers to, in addition to its plain and ordinary meaning, a property that causes a change in object appearance in response to a change in illumination spectra. For example, in some embodiments, the object may be coated with a paint or surface treatment or surface treatment that changes in color with changes in the illuminant spectra.

In some embodiments, the illumination is provided by a light source capable of producing multiple outputs each having the same chromaticity but different spectral distribution. The overall illumination spectrum of the light source includes at least one relatively narrow emission band that falls within the overall illumination spectrum. The remainder of the illumination spectrum can be composed of one or more additional emission bands of similar and/or varied width but all of which fall within the overall spectrum. The overall resulting illumination provided by the light source may be, for example, a white chromaticity suitable for general illumination, although other embodiments may provide other desired chromaticity as will be appreciated.

In some specific embodiments, the light source (in response to a controller command signal) is capable of shifting a first narrow emission band in wavelength while appropriately modifying the rest of the illumination spectrum so that the chromaticity of the light source output remains constant or within an acceptable tolerance. In one such embodiment, the light source is configured with many independently controlled LEDs (or other suitable light sources) emitting at different wavelengths so that a wide range of output spectra is possible. Note that reference herein to chromaticity being "constant" or "the same" includes unchanged chromaticity as well as relatively minor changes in chromaticity where there is no human-perceptible change in chromaticity. As will be further appreciated in light of this disclosure, while some observers may have a so-called heightened sensitivity to changes in chromaticity, a typical observer would generally not be able to detect changes.

Once deployed, a lighting system configured in accordance with an embodiment of the present disclosure can be configured to make changes between different options for object appearance within a short time scale and with minimal effort such as engaging one or more physical buttons or switches or other suitable user interface mechanisms such as a graphical user interface (GUI) that includes one or more virtual control features accessible via a touch screen. For instance, in one example case, a touch screen GUI might include an image of the target object(s) or surface(s) to be changed in appearance, and a number of touch panels or buttons that each depict a corresponding appearance that a given object/surface will take on if that particular panel/button is selected, thereby providing a very intuitive lighting system interface configured to control object appearance.

Illuminant Examples

Numerous illumination sources or so-called illuminants capable of providing a variation in spectral distribution while simultaneously maintaining constant chromaticity will be apparent in light of this disclosure. As an example of variation in spectral distribution which keeps the chromaticity constant, FIG. 1*a* and FIG. 1*b* each shows two white illuminants (Illuminant 1 and Illuminant 2, Illuminant 3 and Illuminant 4, respectively) that can be used in accordance with an embodiment of the present invention. As can be seen, each of Illuminant 1 and Illuminant 2 has a chromaticity on the blackbody curve with a correlated color temperature (CCT) of 4500K with similar color rendering index (CRI), and each of Illuminant 3 and Illuminant 4 has a chromaticity on the blackbody curve with a CCT of 3500K with similar CRI). In general, light having the various spectral distributions shown in FIGS. 1*a-b* would be indistinguishable to humans observing the light directly (the light would appear as a constant white light). In addition, most objects illuminated by the depicted spectra would not differ too much in appearance under the two different illuminants, as many available colorants (e.g., dyes, paints and other such typical surface treatments) have rather broad absorption, reflection, or transmission peaks.

However, and in accordance with an embodiment of the present invention, by carefully selecting or engineering a colorant of an object in conjunction with the spectral distribution of the illuminants, a plurality of distinct differences in appearance could result. In more detail, if the optical response properties of the colorant (for example absorption, reflection, and/or transmission) have relatively narrow spectral features, then the appearance of the colorant can vary more strongly as a function of the illumination spectrum chosen, with the appearance depending on the overlap of the illumination emission bands with the optical response features of the colorant.

By adjusting the overlap of various emission bands in the illumination spectrum to coincide with features in the optical response properties of the colorant, the overall spectrum can be restricted to those that provide suitable white light for general illumination purposes. The overall spectrum can be further restricted if desired to provide white light at constant chromaticity. Thus, the appearance of a colorant (or material with which the target object/surface is composed) could be changed by modifying the spectral distribution of the illumination spectrum, while maintaining general lighting functionality at all times, and if desired, without obvious illumination changes to an observer.

Example Case #1

Colorant A+Illuminants 1 or 2

Figure 2:
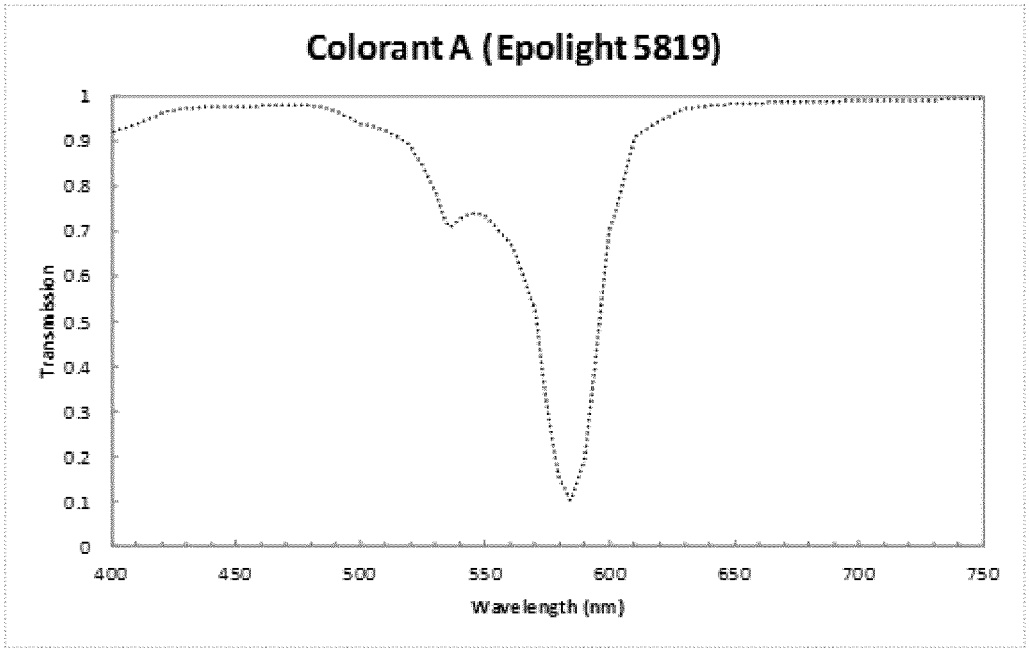
FIG. 2 illustrates an example colorant that can be used in conjunction with the illuminants of FIG. 1*a* so as to allow a given lighting system employing those illuminants to cause appearance changes in the colorant, in accordance with an embodiment of the present invention.

FIG. 2 illustrates an example colorant that can be used in conjunction with the illuminants of FIG. 1*a* so as to allow a given lighting system employing those illuminants to cause appearance changes in the colorant, in accordance with an embodiment of the present invention. As can be seen, the transmission property of this example colorant (Colorant A) has a narrow absorption band near 580 nm. One specific example such colorant is Epolight™ 5819 produced by Epolin, Inc. Depending on the illuminant spectra used, this colorant appears pink or blue (or some recognizable variation of pink or blue, generally referred to as pinkish or blueish, respectively).

Figure 3:
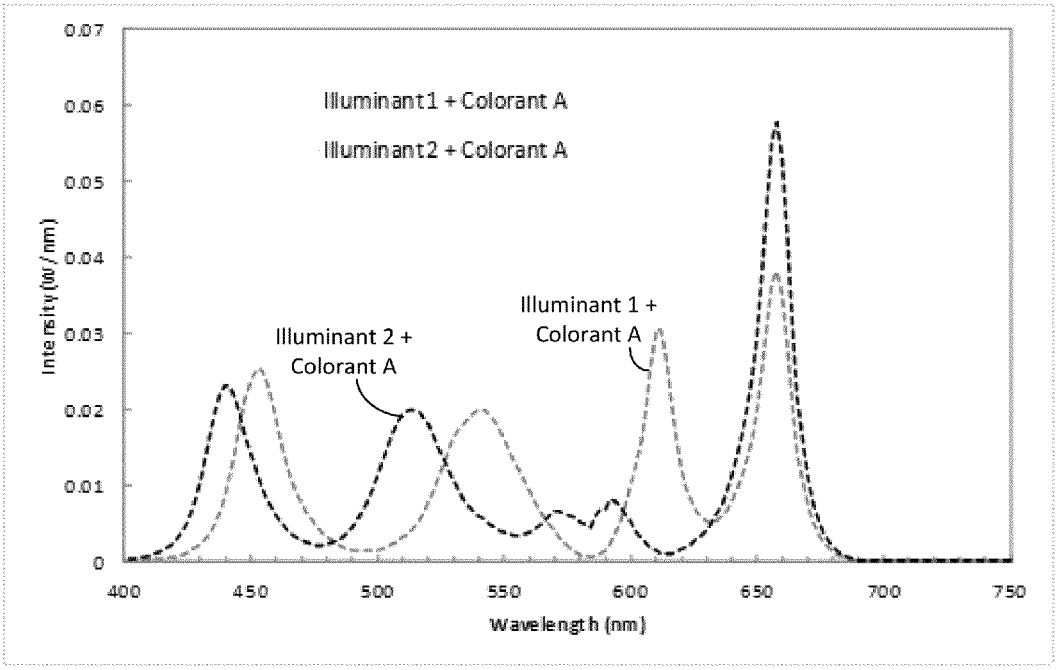
FIG. 3 graphically shows the transmission curve resulting from the combination of the example illuminants of FIG. 1*a* and the colorant of FIG. 2, in accordance with an embodiment of the present invention.

In more detail, the appearance of a specific colorant under different illuminants can be estimated by multiplying the illuminant spectra by the wavelength dependent optical property curve of the colorant. FIG. 3 shows the results of this multiplication for the specific illuminants and colorant given so far (Illuminants 1 and 2 of FIG. 1*a* and Colorant A of FIG. 2). As can be seen in each of FIGS. 1*a* through 3, the overall spectrum of interest ranges from about 400 nm to about 700 nm, which generally corresponds to the visible spectrum as shown in Table 1.

TABLE 1

| Visible Spectrum | |
|---|---|
| Color | Wavelength |
| violet | 380-450 nm |
| blue | 450-495 nm |
| green | 495-570 nm |
| yellow | 570-590 nm |
| orange | 590-620 nm |
| red | 620-750 nm |

So, given the relatively narrow absorption band of Colorant A shown in FIG. 2 in the range of about 500 nm to 620 (with a peak absorption at about 584 nm), the spectral peak of Illuminant 2 in that same range is significantly attenuated or otherwise diminished, as shown in FIG. 3. Given that the other regions in the spectrum of interest are mostly not absorbed by the Colorant A, the other spectral contributions of the Illuminants 1 and 2 are mostly not affected (only green, yellow, and orange are attenuated by Colorant A).

Figure 4A:
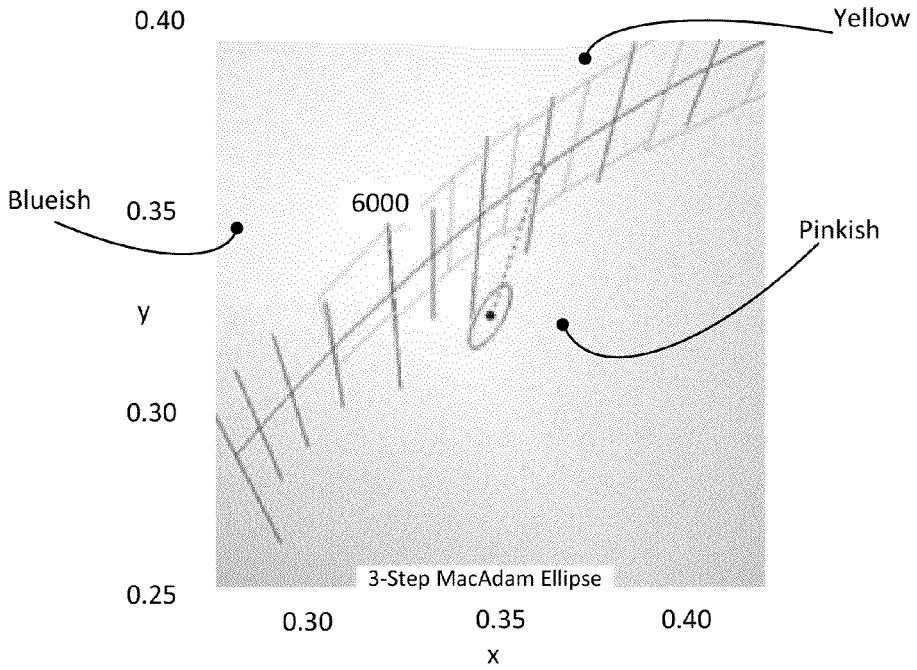
FIG. 4*a* illustrates the resulting chromaticity from the combination of example Illuminant 1 of FIG. 1*a* and the colorant of FIG. 2.
Figure 4B:
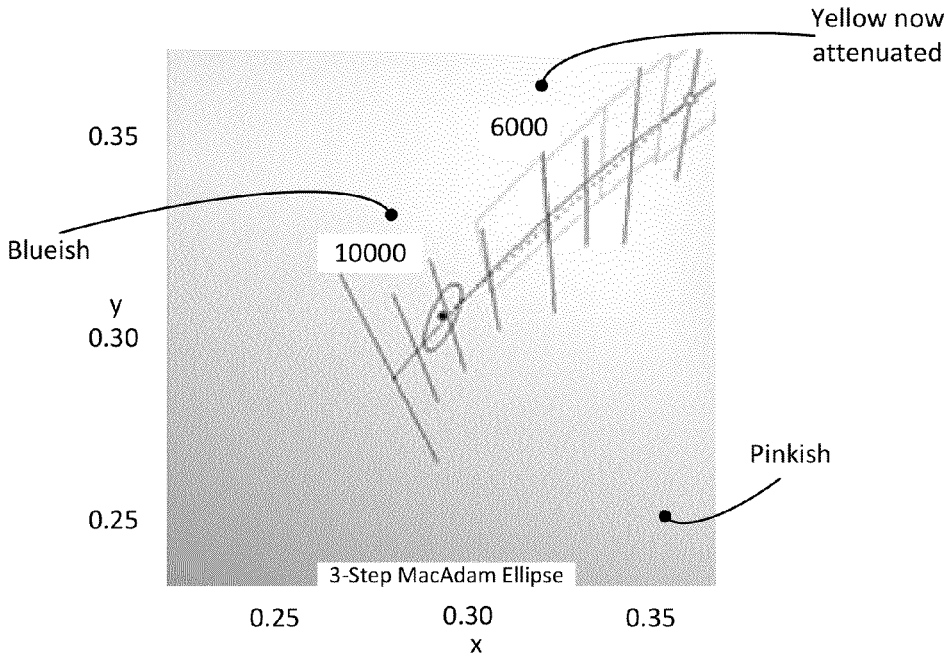
FIG. 4*b* illustrates the resulting chromaticity from the combination of example Illuminant 2 of FIG. 1*a* and the colorant of FIG. 2.

To this end, further note that there is relatively little overlap between the emission peaks of Illuminant 1 and the absorption peak of Colorant A, so there is relatively little change in Illuminant 1 upon transmission through Colorant A. The small loss in the green-yellow part of the overall spectrum would give Colorant A a slightly pinkish (or perhaps purplish) appearance when lit by Illuminant 1, as shown in the chromaticity diagram of FIG. 4*a*. However, and as previously explained, Illuminant 2 has an emission peak at about 584 nm which coincides by design with the absorption peak of Colorant A. Therefore, Illuminant 2 suffers a relatively large loss of its yellow component, giving Colorant A more of a bluish appearance when illuminated by Illuminant 2. This result for Colorant A+Illuminant 2 is shown in the chromaticity diagram of FIG. 4*b*.

Example Case #2

Colorant B+Illuminants 3 or 4

Figure 1B:
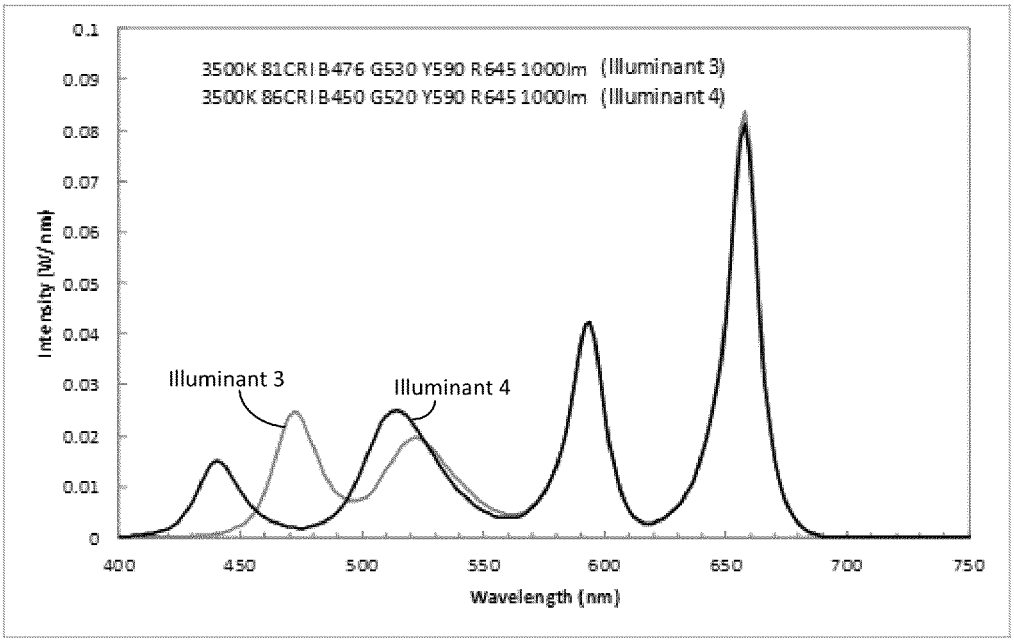
Figure 5:
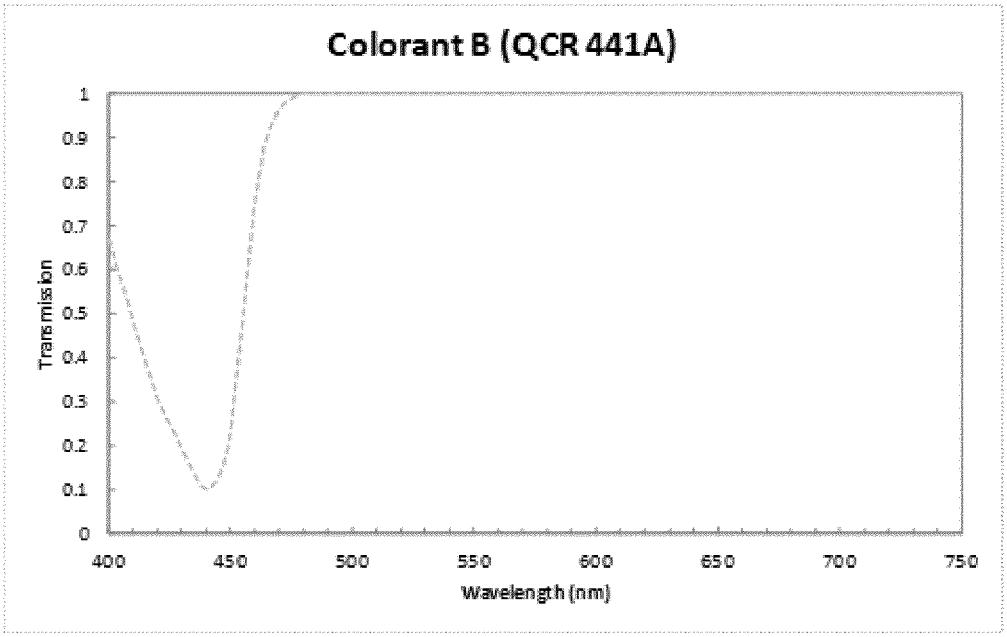
FIG. 5 illustrates another example colorant that can be used in conjunction with the illuminants of FIG. 1*b* so as to allow a given lighting system employing those illuminants to cause appearance changes in the colorant, in accordance with an embodiment of the present invention.

FIG. 5 illustrates another example colorant that can be used in conjunction with the illuminants of FIG. 1*b* so as to allow a given lighting system employing those illuminants to cause appearance changes in the colorant, in accordance with an embodiment of the present invention. As can be seen, the optical properties of Colorant B can be described by the depicted transmission curve which includes a narrow absorption band near 440 nm. One specific example such colorant is VIS441A produced by QCR Solutions Corp. Depending on the illuminant spectra used, this colorant appears white or yellow (or some recognizable variation of white or yellow, generally referred to as whiteish or yellowish, respectively).

Figure 6:
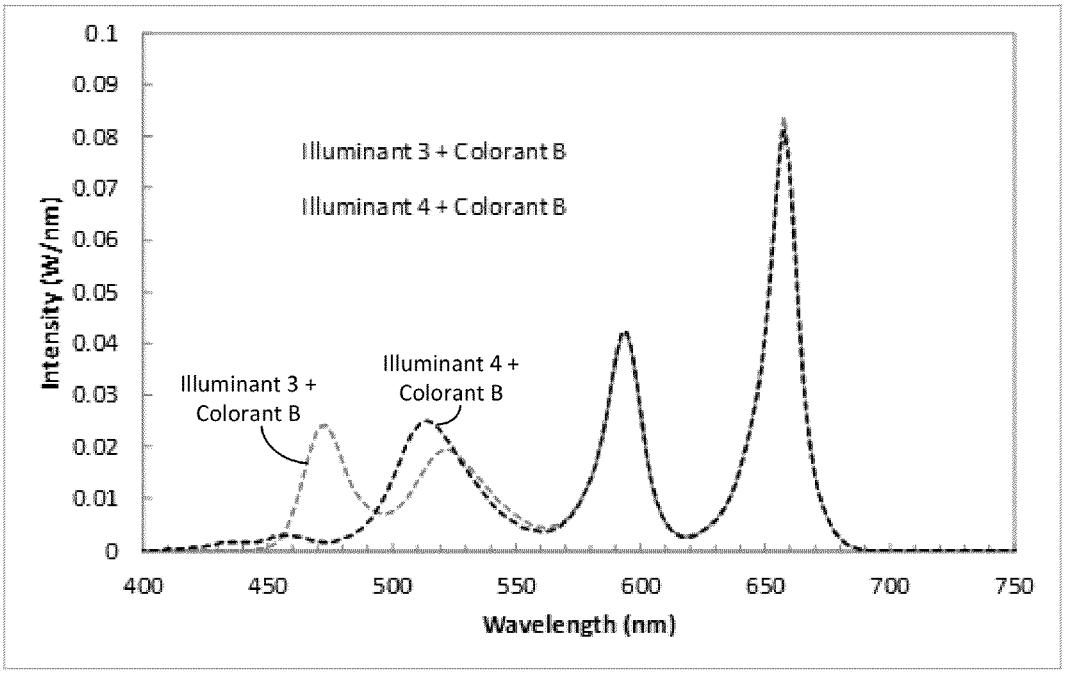
FIG. 6 graphically shows the transmission curve resulting from the combination of the illuminants of FIG. 1*b* and the colorant of FIG. 5, in accordance with an embodiment of the present invention.
Figure 7A:
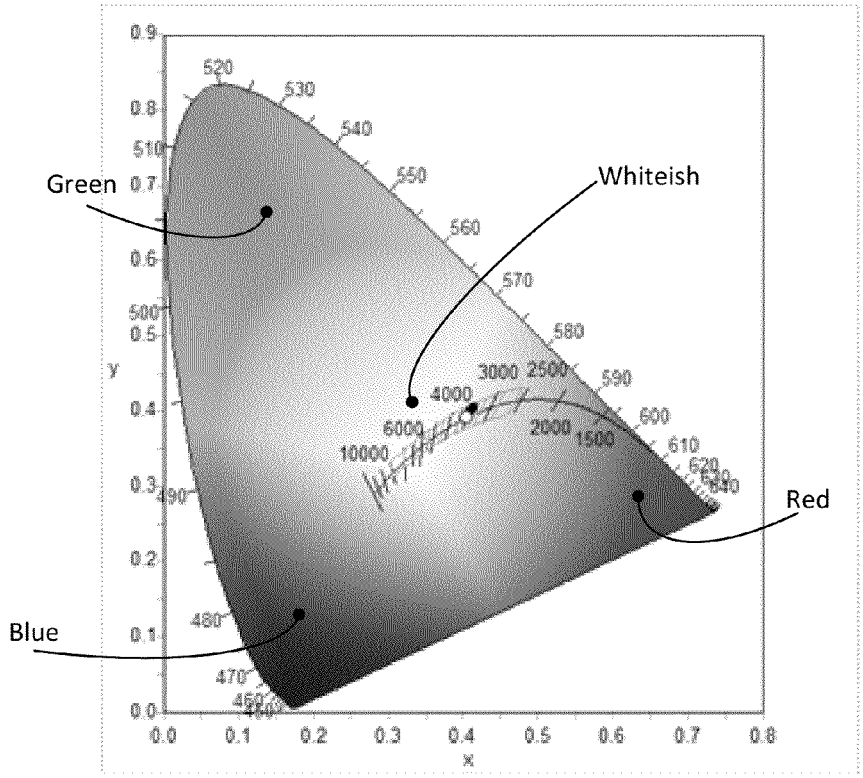
FIG. 7*a* illustrates the resulting chromaticity from the combination of example Illuminant 3 of FIG. 1*b* and the colorant of FIG. 5.
Figure 7B:
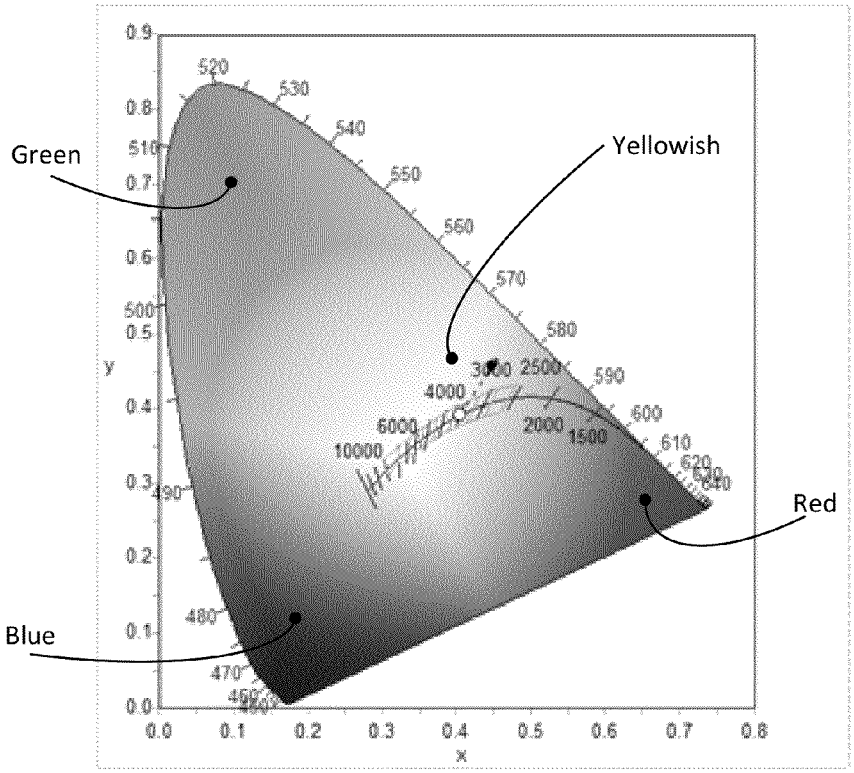
FIG. 7*b* illustrates the resulting chromaticity from the combination of example Illuminant 4 of FIG. 1*b* and the colorant of FIG. 5.

As previously explained, the appearance of a specific colorant under different illuminants can be estimated by multiplying the illuminant spectra by the wavelength dependent optical property curve of the colorant. FIG. 6 shows the results of this multiplication for the specific illuminants and colorant given so far (Illuminants 3 and 4 of FIG. 1*b* and Colorant B of FIG. 5). As can be seen in each of FIGS. 1*b* and 5 through 6, the overall spectrum of interest ranges from about 400 nm to about 700 nm (the visible spectrum, Table 1). Colorant B absorbs blue light at the shortest wavelength part of the visible spectrum. Thus, the blue emission peak of Illuminant 3 at around 470 nm would not be significantly attenuated by Colorant B, so that Colorant B would appear nearly white or perhaps very slightly yellow using this Illuminant 3, as shown in the chromaticity diagram of FIG. 7*a* (area generally designated, 'whiteish'). On the other hand, the blue emission peak of Illuminant 4 at around 450 nm would be significantly attenuated by Colorant B, so that Colorant B would appear distinctly yellow using this Illuminant 4, as shown in the chromaticity diagram of FIG. 7*b* (area generally designated, 'yellowish').

As will be appreciated in light of this disclosure, numerous other combinations of colorants and illuminants are possible. The choice of color changes generally corresponds to the various available colorants with narrow optical features at wavelengths of interest and the available LEDs with narrow line widths at wavelengths of interest. Further note that dyes or other colorants can be combined to control the color shift direction under different illuminants and provide addition colorant options.

Further note that Examples 1 and 2 describe the appearance of objects in transmission, because transmission/absorbance data of colorants tends to be more readily available than reflectance data (with respect to characterizing colorants/dyes). In any case, similar control of reflected colorant appearance can also be used, provided that the reflectance properties have similar relatively narrow features as the transmission. To this end, note that narrow absorbance bands correspond to narrow bands of low transmission and low reflectance. As peaks in the illumination spectrum overlap with bands of low reflectance, the appearance of the illuminated colorant would change.

As will be further appreciated in light of this disclosure, although the various examples provided herein refer to engineering color change via illumination spectra change by utilizing colorants as examples (such as dyes, stains, paints or other coatings or films), note that some objects may have an existing surface treatment that exhibits the desired optical response properties or a given target object may otherwise naturally possess optical response properties which could be exploited as explained herein, so that engineering of the object composition is not required.

As will be further appreciated in light of this disclosure, note that the illuminants need not be limited to those emitting in the visible spectrum. For instance, in another embodiment, at least one of the illuminants may be configured to emit one or more spectral peaks outside the visible spectrum (e.g., shorter than 400 nm). Such an illuminant may be used, for example, in conjunction with colorants in which the color is produced or otherwise changed by fluorescent pigments excited by short wavelength light of the illuminant. Because the short wavelength light is not visible to humans, there is a degree of flexibility in adjusting the amount of this light in the illuminant without causing any noticeable chromaticity changes, yet a variation in the amount of this short wavelength light could be used to vary the amount of fluorescence in the colorant and therefore its appearance. One such embodiment may include a combination of one or more illuminants emitting in the visible spectrum and one or more illuminants emitting in the invisible spectrum. Alternatively, some embodiments may include only visible illuminants or only invisible illuminants to cause the multiple appearances during active illumination of a given target.

System Architecture

Figure 8:
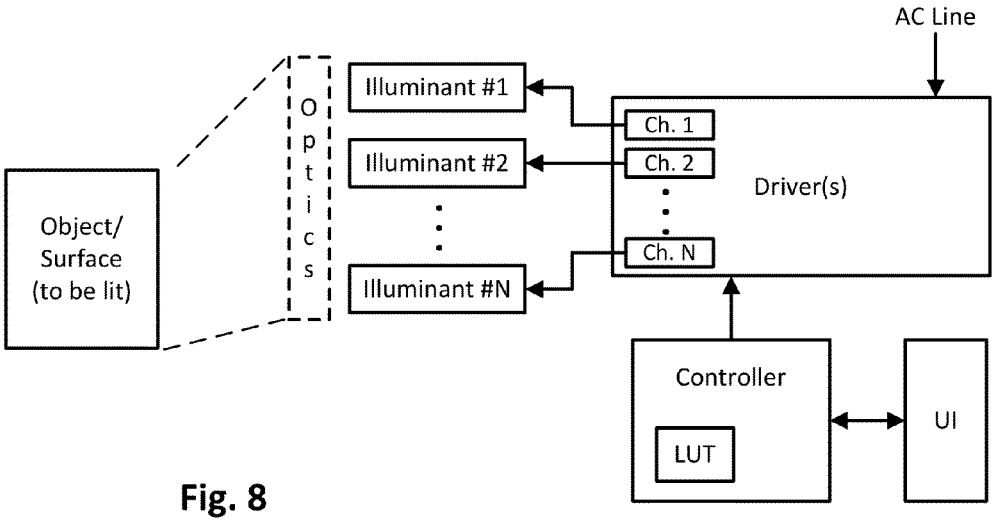
FIG. 8 illustrates a lighting system configured to provide spectral changes for changing an appearance of an object, in accordance with an embodiment of the present invention.

FIG. 8 illustrates a lighting system configured to provide spectral changes for changing an appearance of an object, in accordance with an embodiment of the present invention. As can be seen, the system includes one or more single-channel drivers or one or more multi-channel drivers. In any such cases, each channel output drives a corresponding illuminant. In the example case shown, there are N channels driving N illuminants, but other embodiments may have fewer illuminants than channels. A controller is included with or operatively coupled to the driver, and is programmed or otherwise configured to individually control each of the drive channels (and hence the illuminants). The controller of this example configuration includes a look-up table (LUT) which is configured to receive user input via the user interface (UI) and to translate that user input into one or more control signals, although any number of control schemes can be used, and other embodiments may include a controller that executes control of the driver(s) without using an LUT. In any such cases, the control signals output by the controller selectively control the output channels of the driver(s) and power the illuminants in accordance with the user input. An optional optics assembly may be used to focus and otherwise direct the light output by one or more of the N illuminants to the object and/or surface to be lit.

Each of the N illuminants may be configured, for example, with one or more light emitting diodes (LEDs), wherein each LED or LED string making up one of the N illuminants each provides a chromaticity that is relatively constant from one illuminant to the next. For instance, in one example embodiment, each of the N illuminants emits white light with a chromaticity in the range of 3000 K to 5000 K (on the black-body curve) and wherein the two chromaticities appear to be the same to the average observer. In one specific such case, for example, each of the N illuminants falls within a given 3-step MacAdam ellipse having a chromaticity at its center that represents the chromaticity of one of those N illuminants. In yet another embodiment, each of the N illuminants falls within a given 1-step MacAdam ellipse. In yet another embodiment, each of the N illuminants falls within a given 7-step MacAdam ellipse. Other embodiments accommodating various intermediate sensitivities will be apparent, including those embodiments where the N illuminants fall within a given MacAdam ellipse ranging from 2-step to 6-step.

Figure 9:
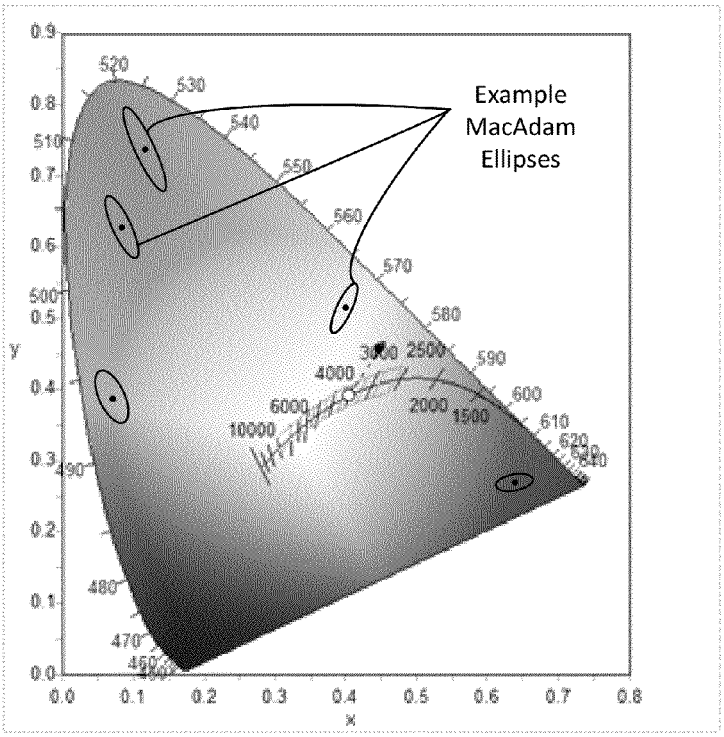
FIG. 9 illustrates an example chromaticity diagram showing numerous MacAdam ellipses for a given observer.

As is known, a 3-step MacAdam ellipse refers to the region on a chromaticity diagram that contains colors which are generally indistinguishable to the average human observer, with respect to the chromaticity at the center of the ellipse. As such, the edge area or perimeter of the ellipse may represent minimally noticeable differences of chromaticity, with such differences being negligible for purposes herein. FIG. 9 illustrates an example chromaticity diagram showing a few MacAdam ellipses for a given observer. Note that only a sample of the various MacAdam ellipses is shown (any x-y coordinate of the plot can be the center of a given MacAdam ellipse), and that the depicted ellipses are much larger than their actual size for purposes of illustration. As will be appreciated, the perceptible chromaticity of a first light source associated with a MacAdam ellipse may appear to be very similar (to an average observer) to the chromaticity of a second light source associated with that same MacAdam ellipse. As will be further appreciated, the smaller the step size of the MacAdam ellipse, the more difficult to discern one chromaticity within that ellipse from another chromaticity within that ellipse.

With further reference to the illuminants of FIG. 8, and in accordance with some such example embodiments, at least one of the N illuminants includes a spectral feature within its overall spectral distribution that is co-located with an opposing spectral feature of the target object/surface. For instance, and as previously discussed with reference to FIGS. 4*a-b* and 7*a-b*, a first of the N illuminants may include an emission peak that is co-located with a first absorbance peak of the target object/surface, so as to provide a first appearance for the object/surface. In a similar fashion, a second of the N illuminants may include another emission peak that is co-located with a second absorbance peak of the target object/surface, so as to provide a second appearance for the object/surface, and so on. Also as previously discussed, a third of the N illuminants may include an emission peak that is not co-located with the first absorbance peak of the target object/surface, so as to provide a third appearance for the object/surface. In a similar fashion, a fourth of the N illuminants may include another emission peak that is not co-located with the second absorbance peak of the target object/surface, so as to provide a fourth appearance for the object/surface, and so on. In an opposite fashion, a given one of the N illuminants may include an emission trough that is co-located with a reflectance peak of the target object/surface so as to provide another appearance, while another of the N illuminants may include an emission peak that is co-located with that reflectance peak of the target object/surface so as to provide yet another appearance. Recall, however, that the illuminant spectrum modifications caused by controlling which of the N illuminants are active are such that the chromaticity remains suitable for a given lighting scheme, and possibly nearly constant so that the modifications to illumination are not perceptible or are otherwise minimally perceptible (e.g., within an acceptable tolerance). Although LEDs are used in some embodiments, other embodiments may use any other light source that can be characterized by an illuminant spectrum having one or more spectral features that can be exploited as explained herein.

The driver may be implemented with any suitable driver technology including any number of topologies such as those including a power factor correction (PFC) stage and a buck converter stage. Other suitable driver configurations may include, for example, a DC to DC converter stage or an AC to DC converter stage with a buck-boost topology. So, while the example driver shown receives an AC line voltage as its input, other embodiments may receive a DC input signal. In a more general sense, any driver circuitry can be used so long as that circuitry can provide an appropriate drive signal to the corresponding illuminant, wherein the appropriate driver signal is generated by the driver in response to a corresponding control signal from the controller.

Like the driver(s), the optional optics assembly can also generally be implemented with conventional technology, and may include any number of lenses for focusing and directing the light to the object/surface to be lit as well as actuators for moving or otherwise manipulating those lenses in response to control signals from, for instance, the controller or some other processor. In addition, the optional optics assembly may further include one or more filters configured to remove or otherwise attenuate a particular spectral feature of the corresponding illuminant (or to accentuate a spectral feature of the illuminant, as the case may be), so as to allow for an appearance change.

The controller can be implemented, for example, with a microcontroller or any other suitable processing environment capable of being configured to receive user input and output suitable driver control signals so as to cause appearance changes to an object/surface as variously described herein. In this example embodiment, an LUT of the controller is configured to correlate specific user input to a specific control signal output. To this end, the LUT may include, for example, one or more drive signals for each of the illuminants indexed by a corresponding input signal. In this example case, the input signal is provided by way of a user interface.

Figure 10A:
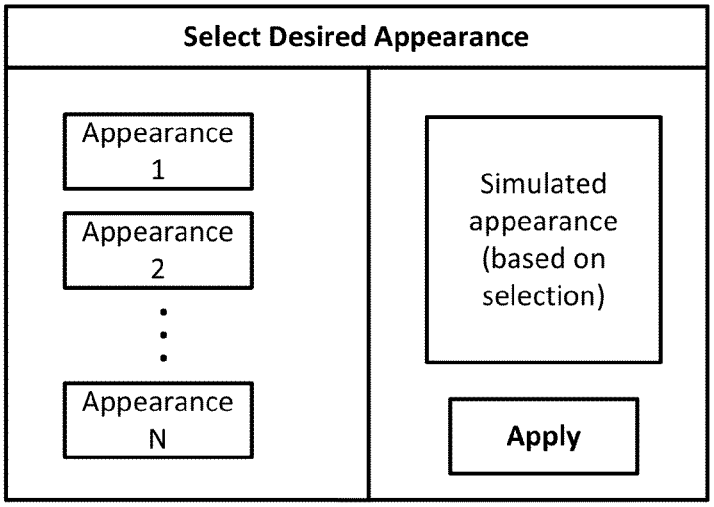
FIGS. 10*a* and 10*b* illustrate example user interfaces that can be used with the system of FIG. 8, in accordance with an embodiment of the present invention.
Figure 10B:
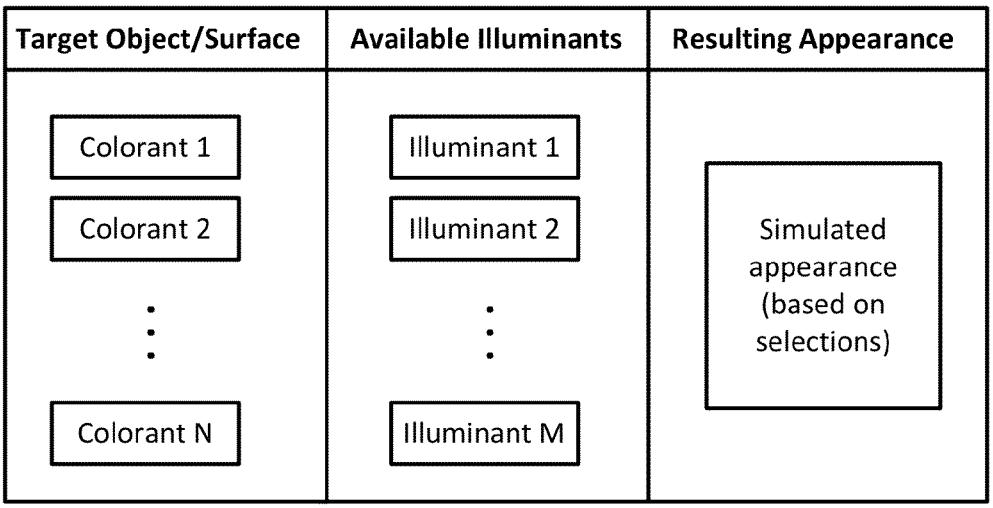

FIGS. 10*a* and 10*b* illustrate example graphical user interfaces that can be used to provide the input, in accordance with an embodiment of the present invention. As can be seen, each of the GUIs allows a user to make choices (e.g., via mouse clicks or appropriately placed taps or other suitable input mechanism), so that a desired appearance of the object/surface is achieved.

The example GUI in FIG. 10*a* allows the user to select an appearance (Appearance 1 through N are provided). Once the desired appearance is selected, the resulting appearance can be simulated on the right-side of the GUI, in some embodiments. If the user likes the simulated appearance, she can apply that appearance to the object/surface by selecting the 'Apply' button or other suitable UI feature), in some such embodiments. Alternatively, the selected appearance can be automatically applied to the object/surface without further input from the user, in other such embodiments.

Table 2 shows an example LUT that could be used in conjunction with the GUI of FIG. 10*a*, in accordance with one example embodiment. As can be seen, once a desired one of available appearances presented to the user (Appearances 1 through N) for a given object/surface has been selected, the corresponding output signal can be identified in the LUT and applied to the driver. So, the available output signals listed in the table are effectively indexed by the various available Appearances 1-N. This example configuration assumes that the optical response properties of the object/surface are established and designed to work in conjunction with the various available illuminants (Illuminants 1 through N, in the example case shown in FIG. 8). Once the output signal is provided to the driver one or more of the illuminants are powered by the driver to illuminate the object/surface with the desired spectral distribution, thereby causing the desired appearance of the object/surface to manifest.

TABLE 2

| Example LUT | |
|---|---|
| Selected Appearance | Output Signal |
| 1 | 0 . . . 001 |
| 2 | 0 . . . 010 |
| . . . | . . . |
| N | 0 . . . 111 |

The example GUI in FIG. 10*b* allows the user to select a colorant (or combination of colorants, as the case may be) that is associated with a given object/surface as well as a given one (or more) of the available illuminants. Once the appropriate colorant and illuminant combination is selected, the resulting appearance can be simulated on the right-side of the GUI. This appearance can be automatically applied, or alternatively, can be applied when the user confirms the input (by selecting an 'Apply' button or other suitable UI feature) as previously explained.

Table 3 shows another example of an LUT that could be programmed or otherwise configured into the controller, in accordance with another embodiment. Such an example LUT could be used in conjunction with the GUI shown in FIG. 10*a*, for instance. Thus, once the user provides a colorant-illuminant combination, the corresponding output signal of the controller can be identified in the LUT and applied to the driver. Note that the GUI in this example embodiment allows the user to experiment with different colorants. So the user can select a dye or paint type based on the simulation, or can apply the colorant to the object and then make the appropriate selections. Note that the user may select a combination of colorants and/or illuminants, and the LUT could be further populated to accommodate such combinational inputs.

TABLE 3

| Example LUT | |
|---|---|
| Colorant-Illuminant Selection | Output Signal |
| 1-1 | 0 . . . 001 |
| 1-2 | 0 . . . 010 |
| . . . | . . . |
| 1-M | 0 . . . 111 |
| 2-1 | 0 . . . 001 |
| 2-2 | 0 . . . 010 |
| . . . | . . . |
| 2-M | 0 . . . 111 |
| 3-1 | 0 . . . 001 |
| 3-2 | 0 . . . 010 |
| . . . | . . . |
| 3-M | 0 . . . 111 |
| . . . | . . . |
| N-1 | 0 . . . 001 |
| N-2 | 0 . . . 010 |
| . . . | . . . |
| N-M | 0 . . . 111 |

APPLICATIONS

Numerous applications for the techniques provided herein will be apparent in light of this disclosure. One general area where the techniques could be beneficially applied is in the field of décor, where the appearance of specific items can be changed by selecting an appropriate illuminant spectrum, which may be desirable, for instance, in museums, art galleries, or a person's home. In a similar fashion, different decorative color or design schemes of the room can be readily applied with appropriate changes in the illuminant spectrum (given the room has already been treated with the appropriate colorants). To this end, walls and/or ceilings can be painted so that their color can be changed. In one specific example embodiment, the previously discussed Example Case #1, which allows a selection of either pink or blue appearance, might be applicable to institutional nursery rooms with rotating occupants, for example (pink for girls, blue for boys). In a similar fashion, the walls and/or ceilings can be selectively treated with a colorant so as to allow different designs or patterns or messages to be manifested depending on the colorant-illuminant combination used. For instance, if the colorant is used to draw a design on wallpaper of carefully chosen background color, the design can be made to appear or disappear by changing the illumination spectrum. The design can be a pattern (thus allowing switching between solids and patterns), or a drawing or a message. In some embodiments, the selection of illuminant spectra can be automated so that the change in décor can be dependent on factors such as the time of day, weather, or other factor. Alternatively, the automated change can be randomized. Any number of such change themes can be used, rather than a specific user input.

Another application is a toy or signage system in which the user is provided with a set of paints (colorants) having narrow absorption/reflectivity bands, which may additionally fluoresce when excited at narrow absorption bands. The images, messages, etc drawn with these paints can be illuminated by a special lighting device which cycles through various spectra that all have the same chromaticity so that lighting changes are not obvious. But due to variation in the spectra, the painted images would appear to have dynamic color changes. Another example application is to use the changing appearance of colorants as a method of communication with the occupants of a room, since the lighting provided by the illuminants can be remotely controllable on a network.

As will be further appreciated in light of this disclosure, when a given colorant does not have narrow spectral features in its optical response properties, a lighting system can still be set up which allows the user to finely adjust the color appearance of that colorant. For example, a colorant which broadly reflects green and broadly absorbs other colors will generally appear green in white light. However, the specific type of green may depend on the specific wavelength of a green peak in the illumination spectrum. Thus, in some embodiments, the user may be given a control to adjust the wavelength of the green peak to get a specific desired green color (a series of driver channels each connected to a LED string having a different wavelength of green, or a broad green spectrum LED string and a variable filter mechanism that passes different green color wavelengths. In some such embodiments, the system could further be equipped with a feedback loop (e.g., firmware or code executable within the system controller) to adjust other parts of the illumination spectrum so that the perceptible chromaticity of the illumination remains at or within a desired target (e.g., such as within a 3-step MacAdam ellipse of a target chromaticity, $T_{chroma}$; alternatively, and with respect to the blackbody curve, $T_{chroma}$+/−10%, or $T_{chroma}$+/−5%, or $T_{chroma}$+/−2%, or $T_{chroma}$+/−1%, or $T_{chroma}$+/−0.5%, where $T_{chroma}$ is in the range of 2500K to 5000K). This may entail shifting the wavelengths or adjusting the intensities of a relatively few number of emission peaks, in some embodiments. In this way, the color of an illuminated object may be finely adjusted while keeping the appearance of the illumination constant.

Numerous variations will be apparent in light of this disclosure. For instance, one example embodiment provides a method. The method includes illuminating a given target with a first light source so as to cause the target to have a first appearance, the first light source having a chromaticity centered within a first MacAdam ellipse. The method further includes illuminating the target with a second light source so as to cause the target to have a second appearance that is visibly different from the first appearance, the second light source having a chromaticity within the first MacAdam ellipse. In some such cases, the first MacAdam ellipse is a 7-step MacAdam ellipse or smaller. In some cases, the method includes illuminating the target with a third light source so as to cause the target to have a third appearance that is different from the first and second appearances, the third light source having a chromaticity within the first MacAdam ellipse. In some cases, the first MacAdam ellipse is a 3-step MacAdam ellipse or smaller. In some cases, one of the first or second light sources includes a spectral feature not included in the other light source, and an optical response property of the target reacts to changes in the spectral feature thereby causing changes in appearance. In some cases, the first appearance includes a first color and the second appearance includes a second color. In some cases, the first appearance includes a first message and the second appearance includes a second message. In some cases, the first appearance includes a first pattern and the second appearance includes a second pattern. In some cases, the target has an optical response property that reacts to spectral changes caused by changing illumination of the target from the first light source to the second light source. In some cases, the target includes a surface treated with a colorant having the optical response property. In some cases, the first MacAdam ellipse is a 1-step MacAdam ellipse.

Another embodiment of the present invention provides a lighting system. The system includes a plurality of output channels each configured to provide power to a light source, and a controller configured to individually control the output channels. The control includes activating a first one of the output channels to illuminate a given target with a first light source having a first chromaticity so as to cause the target to have a first appearance, and activating a second one of the output channels to illuminate the target with a second light source having a second chromaticity so as to cause the target to have a second appearance. The second chromaticity is within a MacAdam ellipse having the first chromaticity. The MacAdam ellipse is a 7-step MacAdam ellipse or smaller. In some cases, the control further includes activating a third one of the output channels to illuminate the target with a third light source having a third chromaticity so as to cause the target to have a third appearance, wherein the third chromaticity is within the MacAdam ellipse having the first and second chromaticities. In some cases, the first MacAdam ellipse is a 3-step MacAdam ellipse or smaller. In some cases, one of the first or second light sources includes a spectral feature not included in the other light source, and an optical response property of the target reacts to changes in the spectral feature thereby causing changes in appearance. In some cases, the first appearance includes a first color and the second appearance includes a second color. In some cases, the first appearance includes a first message and/or pattern and the second appearance includes a second message and/or pattern. In some cases, the first MacAdam ellipse is a 1-step MacAdam ellipse.

Another embodiment of the present invention provides a lighting system. In this example case, the system includes a target to be illuminated, and a plurality of light sources including a first light source having a first chromaticity and a second light source having a second chromaticity, wherein the second chromaticity is within a 3-step MacAdam ellipse having the first chromaticity. The system further includes a plurality of output channels each configured to provide power to a corresponding one of the light sources, and a controller configured to individually control the output channels. The control includes activating a first one of the output channels to illuminate the target with the first light source so as to cause the target to have a first appearance, and activating a second one of the output channels to illuminate the target with the second light source so as to cause the target to have a second appearance. One of the first or second light sources includes a spectral feature not included in the other light source, and an optical response property of the target reacts to changes in the spectral feature thereby causing changes in appearance. In some cases, the first appearance includes a first color, message, and/or pattern and the second appearance includes a second color, message, and/or pattern. In some cases, the first MacAdam ellipse is a 1-step MacAdam ellipse.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A method, comprising:

illuminating a given target with a first light source so as to cause the target to have a first appearance, the first light source having a chromaticity centered within a first MacAdam ellipse; and illuminating the target with a second light source so as to cause the target to have a second appearance that is visibly different from the first appearance, the second light source having a chromaticity within the first MacAdam ellipse;

wherein the first MacAdam ellipse is a 7-step MacAdam ellipse or smaller.

2. The method of claim 1, further comprising:

illuminating the target with a third light source so as to cause the target to have a third appearance that is different from the first and second appearances, the third light source having a chromaticity within the first MacAdam ellipse.

3. The method of claim 1 wherein the first MacAdam ellipse is a 3-step MacAdam ellipse or smaller.

4. The method of claim 1 wherein one of the first or second light sources includes a spectral feature not included in the other light source, and an optical response property of the target reacts to changes in the spectral feature thereby causing changes in appearance.

5. The method of claim 1 wherein the first appearance includes a first color and the second appearance includes a second color.

6. The method of claim 1 wherein the first appearance includes a first message and the second appearance includes a second message.

7. The method of claim 1 wherein the first appearance includes a first pattern and the second appearance includes a second pattern.

8. The method of claim 1 wherein the target has an optical response property that reacts to spectral changes caused by changing illumination of the target from the first light source to the second light source.

9. The method of claim 8 wherein the target includes a surface treated with a colorant having the optical response property.

10. The method of claim 1 wherein the first MacAdam ellipse is a 1-step MacAdam ellipse.

11. A lighting system, comprising:

a plurality of output channels each configured to provide power to a light source; and a controller configured to individually control the output channels, wherein the control includes activating a first one of the output channels to illuminate a given target with a first light source having a first chromaticity so as to cause the target to have a first appearance, and activating a second one of the output channels to illuminate the target with a second light source having a second chromaticity so as to cause the target to have a second appearance, wherein the second chromaticity is within a MacAdam ellipse having the first chromaticity;

wherein the MacAdam ellipse is a 7-step MacAdam ellipse or smaller.

12. The system of claim 11, wherein the control further includes activating a third one of the output channels to illuminate the target with a third light source having a third chromaticity so as to cause the target to have a third appearance, wherein the third chromaticity is within the MacAdam ellipse having the first and second chromaticities.

13. The system of claim 11 wherein the first MacAdam ellipse is a 3-step MacAdam ellipse or smaller.

14. The system of claim 11 wherein one of the first or second light sources includes a spectral feature not included in the other light source, and an optical response property of the target reacts to changes in the spectral feature thereby causing changes in appearance.

15. The system of claim 11 wherein the first appearance includes a first color and the second appearance includes a second color.

16. The system of claim 11 wherein the first appearance includes a first message and/or pattern and the second appearance includes a second message and/or pattern.

17. The system of claim 11 wherein the first MacAdam ellipse is a 1-step MacAdam ellipse.

18. A lighting system, comprising:

a target to be illuminated;

a plurality of light sources including a first light source having a first chromaticity and a second light source having a second chromaticity, wherein the second chromaticity is within a 3-step MacAdam ellipse having the first chromaticity;

a plurality of output channels each configured to provide power to a corresponding one of the light sources; and a controller configured to individually control the output channels, wherein the control includes activating a first one of the output channels to illuminate the target with the first light source so as to cause the target to have a first appearance, and activating a second one of the output channels to illuminate the target with the second light source so as to cause the target to have a second appearance;

wherein one of the first or second light sources includes a spectral feature not included in the other light source, and an optical response property of the target reacts to changes in the spectral feature thereby causing changes in appearance.

19. The system of claim 18 wherein the first appearance includes a first color, message, and/or pattern and the second appearance includes a second color, message, and/or pattern.

20. The system of claim 18 wherein the first MacAdam ellipse is a 1-step MacAdam ellipse.

* * * * *